US010147317B2

(12) United States Patent
Hirata et al.

(10) Patent No.: US 10,147,317 B2
(45) Date of Patent: Dec. 4, 2018

(54) TRAFFIC INFORMATION ESTIMATION DEVICE AND TRAFFIC INFORMATION ESTIMATION METHOD

(71) Applicant: MITSUBISHI ELECTRIC CORPORATION, Tokyo (JP)

(72) Inventors: Akira Hirata, Tokyo (JP); Junya Ujiie, Tokyo (JP); Michinori Yoshida, Tokyo (JP); Yoshihiro Tomaru, Tokyo (JP); Mitsuo Shimotani, Tokyo (JP); Ryo Okabe, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/542,361

(22) PCT Filed: Mar. 24, 2015

(86) PCT No.: PCT/JP2015/001647

§ 371 (c)(1),
(2) Date: Jul. 7, 2017

(87) PCT Pub. No.: WO2016/151625

PCT Pub. Date: Sep. 29, 2016

(65) Prior Publication Data

US 2018/0276990 A1 Sep. 27, 2018

(51) Int. Cl.
*G08G 1/00* (2006.01)
*G08G 1/096* (2006.01)
(Continued)

(52) U.S. Cl.
CPC ..... *G08G 1/096* (2013.01); *G08G 1/0133* (2013.01); *G08G 1/0141* (2013.01); *G08G 1/096791* (2013.01)

(58) Field of Classification Search
CPC .... G08G 1/096; G08G 1/1033; G08G 1/0141; G08G 1/096791
(Continued)

(56) References Cited

U.S. PATENT DOCUMENTS 9,014,955 B2 * 4/2015 Sakakibara ..... G08G 1/0116 701/118
9,162,686 B2 * 10/2015 Ogawa ..... G01P 1/103
(Continued)

FOREIGN PATENT DOCUMENTS

JP 2001-84486 A 3/2001
JP 2009-116508 A 5/2009
(Continued)

*Primary Examiner* — Daryl Pope
(74) *Attorney, Agent, or Firm* — Birch, Stewart, Kolasch & Birch, LLP

(57) ABSTRACT

This disclosure relates to a traffic information estimation device and a traffic information estimation method for estimating a time period of switching of a traffic signal display. The traffic information estimation device includes: an acquisition unit (203) acquiring arrangement information indicating an arrangement of vehicles in accordance with a time passage on a road on which a traffic signal is installed; a determination unit (205) determining changes in density of the vehicles by using the arrangement information; and a calculation unit (206) calculating a display change cycle indicating a time period of switching of a display of the traffic signal based on a time interval between the changes in density of the vehicles. According to such a configuration, it is possible to simplify processing to estimate of a change cycle of the traffic signal.

9 Claims, 10 Drawing Sheets

(51) Int. Cl.
*G08G 1/01* (2006.01)
*G08G 1/0967* (2006.01)

(58) Field of Classification Search
USPC ..... 340/901–905, 937, 425.5, 438
See application file for complete search history.

(56) References Cited

U.S. PATENT DOCUMENTS

| | | | | |
|---|---|---|---|---|
| 9,183,743 | B2 * | 11/2015 | Vahidi | G08G 1/0141 |
| 9,412,272 | B2 * | 8/2016 | Lee | G08G 1/07 |
| 9,947,218 | B2 * | 4/2018 | Murai | G08G 1/0112 |
| 2009/0105942 | A1 | 4/2009 | Lin et al. | |
| 2013/0076538 | A1 | 3/2013 | Uno et al. | |

FOREIGN PATENT DOCUMENTS

| | | | |
|---|---|---|---|
| JP | 2012-146034 | A | 8/2012 |
| JP | 2012-208585 | A | 10/2012 |
| JP | 2012-221167 | A | 11/2012 |
| JP | 2013-73480 | A | 4/2013 |
| JP | 2013-130931 | A | 7/2013 |
| JP | 2014-59823 | A | 4/2014 |

* cited by examiner 402 403 404

| index | Identifier | Position Information | Time Information |
|---|---|---|---|
| 1 | 00:02:03:00:5e:32 | N 3541.1493<br>E 13945.3994 | 085120.307 |
| 2 | 00:01:23:f0:42:ba | N 3541.1441<br>E 13945.3981 | 085122.285 |
| 3 | 00:02:53:20:12:38 | N 3541.1478<br>E 13945.3992 | 085120.312 |
| 4 | 00:01:03:c0:32:4c | N 3541.1434<br>E 13945.3980 | 085121.052 |
| 5 | | | |

FIG.11A

Density State and Time of Occurrence

| Sequence Number | Just This Side of Traffic Signal | Just Far Side of Traffic Signal | Time of Occurrence |
|---|---|---|---|
| 1 | Sparse → Dense | Sparse → 0 | 2014/12/10 11:20:30 |
| 2 | Dense → Sparse | 0 → Sparse | 2014/12/10 11:23:30 |
| 3 | Sparse → Dense | Sparse → 0 | 2014/12/10 11:26:30 |
| 4 | Dense → Sparse | 0 → Sparse | 2014/12/10 11:29:30 |
| 5 | | | |

FIG.11B

Change Of Traffic Signal and Time of Occurrence (Information Table)

| Sequence Number | Just This Side of Traffic Signal | Time of Occurrence |
|---|---|---|
| 1 | Green → Red | 2014/12/10 11:20:30 |
| 2 | Red → Green | 2014/12/10 11:23:30 |
| 3 | Green → Red | 2014/12/10 11:26:30 |
| 4 | Red → Green | 2014/12/10 11:29:30 |
| 5 | | |

FIG.11C

Display Change Cycle (Information Table)

| Traffic Signal Display | Duration Time of Traffic Signal State |
|---|---|
| Red | 3 Minutes |
| Green | 3 Minutes |
| | |

TRAFFIC INFORMATION ESTIMATION DEVICE AND TRAFFIC INFORMATION ESTIMATION METHOD

TECHNICAL FIELD

The present invention relates to a traffic information estimation device and a traffic information estimation method that estimate a switching period of a traffic signal display.

BACKGROUND ART

In a case in which a vehicle is driven in accordance with traffic signals, when a traffic signal ahead of the vehicle is red or yellow, by performing an operation of stopping an accelerator operation and moving the vehicle to coast to a stop position, fuel-efficient driving can be realized.

However, in a case where a vehicle travels at a constant velocity and reaches the vicinity of a traffic signal, when a deceleration operation is performed in accordance with the change in the traffic signal from green to yellow, the fuel-efficiency decreases. On the other hand, if an acceleration operation is performed to forcibly pass the traffic signal, the fuel-efficiency further decreases, and in addition, there is a possibility that an appropriateness of driving operation is imp aired.

Accordingly, from a viewpoint of the fuel-efficiency or safety speed travelling of a vehicle, it is important to know the timing when the traffic signal ahead of the vehicle changes.

For example, Patent Literature 1 discloses the following method: when a server is informed of a distance from a host vehicle to a traffic signal, the server calculates the optimal speed based on the distance to the traffic signal and the time until the traffic signal changes, and the optimal speed is provided to the host vehicle.

Patent Literature 2 discloses the following method: a time when the display of a traffic signal is changed is calculated based on the delay time between when the leading vehicle of a vehicle group stopping behind a traffic signal starts moving and when a target vehicle starts moving, and the distance from the target vehicle to the traffic signal. Then, the information acquired by a plurality of vehicles is integrated in a center to estimate the display change cycle of the target traffic signal.

In each of Patent Literature 3 and Patent Literature 4, a methods of sharing traffic information or the like by forming an ad hoc network based on vehicle-to-vehicle communication for performing data communication between vehicles is disclosed.

CITATION LIST

Patent Literature

Patent Literature 1: Japanese Unexamined Patent Application Publication No. 2012-208585

Patent Literature 2: Japanese Unexamined Patent Application Publication No. 2009-116508

Patent Literature 3: Japanese Unexamined Patent Application Publication No. 2012-146034

Patent Literature 4: Japanese Unexamined Patent Application Publication No. 2014-059823

SUMMARY OF INVENTION

Technical Problem

Patent Literature 1 discloses a method of informing the host vehicle of an optimal speed. In this Patent Literature 1, display switching of each traffic signal is centrally managed, and the time until a traffic signal changes is registered in advance. Therefore, there exists a problem that the method is not valid for traffic signals that are not centrally managed regarding the display change cycle of the traffic signal display.

Patent Literature 2 discloses a method of estimating a display change cycle of a traffic signal, in which the change cycle of a traffic signal is estimated based on the delay time between when the leading vehicle of a vehicle group stopping behind the traffic signal starts moving and when the target vehicle starts moving. Therefore, it is required to trace a traveling state of a specific target vehicle and therefore the processing becomes complicated.

In each of Patent Literature 3 and Patent Literature 4, a methods of sharing traffic information or the like between vehicles is disclosed. However, the estimation of the display change cycle of a traffic signal is not disclosed.

The present invention is made in order to solve, for example, the above-mentioned problems, and it is therefore an object of the present invention to simplify processing for estimating a change cycle of a traffic signal.

Solution to Problem

A traffic information estimation device according to the present invention is mounted on each of vehicles and performing a vehicle-to-vehicle communication between the vehicles on a road on which a traffic signal is installed and forming a network by sharing information via the vehicle-to-vehicle communication. The traffic information estimation device includes: an acquisition unit acquirer acquiring a distribution data including position information indicating respective positions of the vehicles and time information indicating time points when the vehicles were present at the respective positions, which are accumulated in each of the vehicles on the road, from one of the vehicles forming the network, and acquiring arrangement information indicating an arrangement of the vehicles in accordance with a time passage on the road on which the traffic signal is installed by using the distribution data; a determinator determining changes in a density of the vehicles by using the arrangement information; and a calculator calculating a display change cycle indicating a time period of switching of a display of the traffic signal based on a time interval between the changes in the density of the vehicles.

A traffic information estimation method performing a vehicle-to-vehicle communication between vehicles via a traffic information estimation device mounted on each of vehicles on a road on which a traffic signal is installed and forming a network by sharing information via the vehicle-to-vehicle communication, the method includes: acquiring a distribution data including position information indicating respective positions of the vehicles and time information indicating time points when the vehicles were present at the respective positions, which are accumulated in each of the vehicles on the road, from one of the vehicles forming the network, and acquiring arrangement information indicating an arrangement of the vehicles in accordance with a time passage on the road on which the traffic signal is installed by using the distribution data; determining changes in density of the vehicles by using the arrangement information; and calculating a display change cycle indicating a time period of switching of a display of the traffic signal based on a time interval between the changes in density of the vehicles.

Advantageous Effects of Invention

According to the traffic information estimation device of the present invention, it is possible to simplify processing for estimating the change cycle of a traffic signal.

According to the traffic information estimation method of the present invention, it is possible to simplify processing for estimating the change cycle of a traffic signal.

BRIEF DESCRIPTION OF DRAWINGS

FIGS. 11A to 11C are tables for illustrating a relationship between changes in density of vehicles and changes in traffic signal;

DESCRIPTION OF EMBODIMENTS

Figure 1:
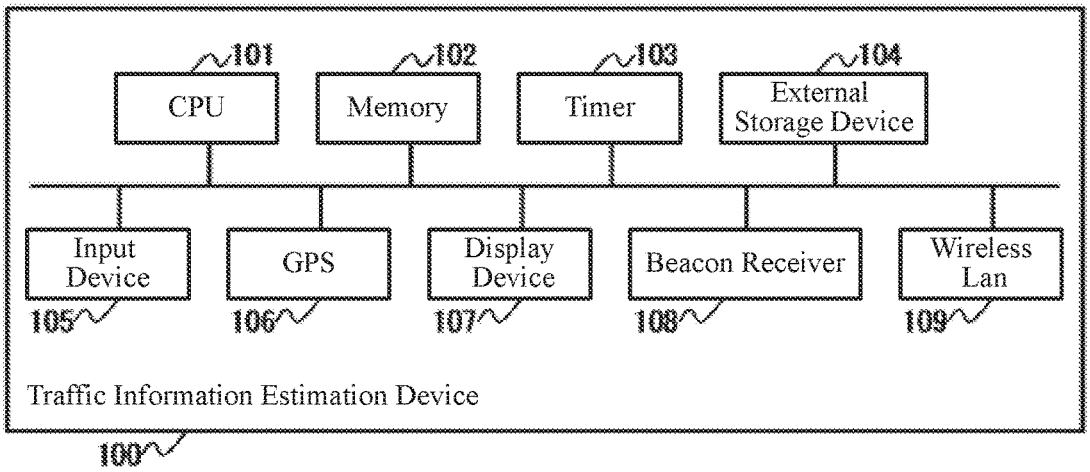
FIG. 1 is a configuration diagram for illustrating an example of a hardware configuration of a traffic information estimation device 100 according to Embodiment 1.

Hereinafter, some embodiments will be explained for explaining the present invention in detail. Note that, the following embodiments are examples for explaining the present invention, and the present invention is not limited to them. In each of the figures, same reference numerals are assigned to identical or corresponding parts.

Embodiment 1

FIG. 1 is a configuration diagram for illustrating an example of a hardware configuration of a traffic information estimation device 100 according to Embodiment 1, which is an embodiment of the present invention. Note that, FIG. 1 illustrates an example of a case in which the traffic information estimation device 100 is mounted on a vehicle.

As shown in FIG. 1, the traffic information estimation device 100 includes a CPU (Central Processing Unit) 101, a memory 102, a timer 103, an external storage device 104, an input device 105, a GPS (Global Positioning System) 106, a display device 107, a beacon receiver 108, and a wireless LAN (Local Area Network) 109.

The CPU 101 is an arithmetic unit, and executes software used for the device in this embodiment. The CPU reads out programs and data stored in the memory 102 or the external storage device 104, and implements each of the functions of the device according to this embodiment by executing the software (the programs).

The memory 102 stores program execution codes and data for implementing each of the functions of the device in this embodiment. The memory 102 is constituted by, for example, a ROM (Read Only Memory), a RAM (Random Access Memory), an HDD (Hard Disk Drive), or an SSD (Solid State Drive).

The timer 103 manages time in the traffic information estimation device 100. The timer 103 is constituted by, for example, a clock management circuit.

The external storage device 104 stores map data including information of a road for traveling, and the data that is required for processing to implement each function of the device according to this embodiment. The external storage device 104 may store the program execution codes and the like for implementing each function of the device according to this embodiment. The external storage device 104 is constituted by, for example, a ROM (Read Only Memory), a RAM (Random Access Memory), an HDD (Hard Disk Drive), or an SSD (Solid State Drive).

The input device 105 receives an input operation from the outside. The input device 105 is constituted by, for example, a mouse, a keyboard, a touch panel and the like.

The GPS 106 acquires the latitude and longitude of the measurement position by receiving radio waves from satellites, and acquires electrical time information from the satellites.

The display device 107 displays information to provide it to the driver of the vehicle. The display device is composed of, for example, a liquid crystal display or an LED (Light Emitting Diode) display.

The beacon receiver 108 receives a beacon signal transmitted from a device installed at, for example, a side of the road.

The wireless LAN 109 is a device for communicating with the outside. For example, the wireless LAN 109 performs vehicle-to-vehicle communication.

Figure 2:
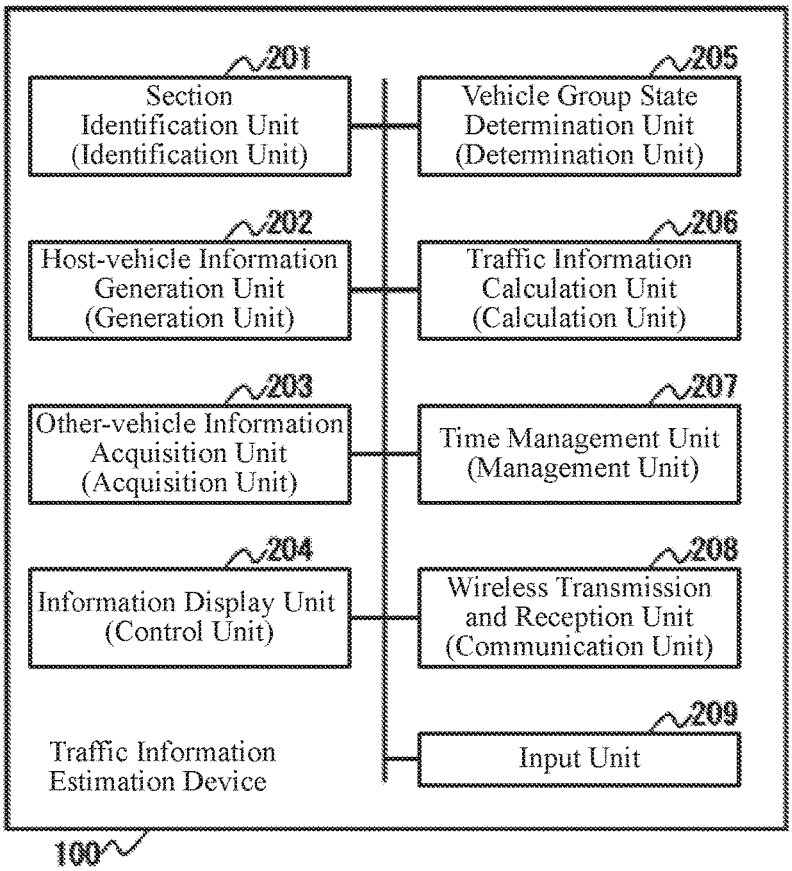
FIG. 2 is a block diagram for illustrating an example of a functional configuration of the traffic information estimation device 100 according to Embodiment 1.

FIG. 2 is a block diagram for illustrating an example of a functional configuration of the traffic information estimation device 100 according to Embodiment 1, which is one embodiment of the present invention.

In FIG. 2, the traffic information estimation device 100 includes a section identification unit 201, a host-vehicle information generation unit 202, an other-vehicle information acquisition unit 203, an information display unit 204, a vehicle group state determination unit 205, a traffic information calculation unit 206, a time management unit 207, a wireless transmission and reception unit 208, and an input unit 209.

Note that the host-vehicle information generation unit 202 corresponds to a generation unit. The other-vehicle information acquisition unit 203 corresponds to an acquisition unit. The information display unit 204 corresponds to a control unit. The vehicle group state determination unit 205 corresponds to a determination unit. The traffic information calculation unit 206 corresponds to a calculation unit. The wireless transmission and reception unit 208 corresponds to a communication unit.

The section identification unit 201 determines whether the host vehicle is present in a specific section that is pre-specified on the road. For example, programs and data for implementing the function of the section identification unit 201 are stored in the memory 102 or the external storage device 104. The CPU 101 appropriately reads out the programs and the data stored in the memory 102 or the external storage device 104, and implements the function of the section identification unit 201. For example, the position where the host vehicle is present is determined by using the beacon signal received by the beacon receiver 108.

The host-vehicle information generation unit 202 generates distribution data including position information indicating the position of the host vehicle and time information indicating the time at which the host vehicle was present at the position. For example, programs and data for implementing the function of the host-vehicle information generation unit 202 are stored in the memory 102 or the external storage device 104. The CPU 101 appropriately reads out the programs and the data stored in the memory 102 or the external storage device 104, and implements the function of the host-vehicle information generation unit 202. Note that the position information indicating the position of the host vehicle and the time information indicating the time at which the host vehicle was present at the position are acquired by the GPS 106.

The other-vehicle information acquisition unit 203 acquires arrangement information indicating an arrangement of vehicles in accordance with a time passage on the road on which a traffic signal is installed. In this explanation, the other-vehicle information acquisition unit 203 acquires the arrangement information from position information indicating positions of vehicles and time information indicating the time points at which the vehicles were present at the positions, which are included in the distribution data received from other vehicles.

For example, programs and data for implementing the function of the other-vehicle information acquisition unit 203 are stored in the memory 102 or the external storage device 104. The CPU 101 appropriately reads out the programs and the data stored in the memory 102 or the external storage device 104, and implements the function of the other-vehicle information acquisition unit 203.

The information display unit 204 displays information so that a person such as the driver of the host vehicle can visibly recognize the information. The information display unit 204 corresponds to the display device 107. Programs and data for implementing functions for controlling contents of information to be displayed and controlling the display device are stored in the memory 102 or the external storage device 104. The CPU 101 appropriately reads out the programs and the data stored in the memory 102 or the external storage device 104 to implement the function.

The vehicle group state determination unit 205 determines changes in the density of vehicles in accordance with arrangement information indicating an arrangement of vehicles in accordance with a time passage on the road on which a traffic signal is installed. For example, programs and data for implementing the function of the vehicle group state determination unit 205 are stored in the memory 102 or the external storage device 104. The CPU 101 appropriately reads out the programs and the data stored in the memory 102 or the external storage device 104 to implement the function of the vehicle group state determination unit 205.

The traffic information calculation unit 206 uses the determination result of changes in the density of vehicles determined by the vehicle group state determination unit 205 to calculate a display change cycle indicating a switching period of a traffic signal display based on a time interval between the changes. For example, programs and data for implementing the function of the traffic information calculation unit 206 are stored in the memory 102 or the external storage device 104. The CPU 101 appropriately reads out the programs and the data stored in the memory 102 or the external storage device 104 to implement the function of the traffic information calculation unit 206.

The time management unit 207 corresponds to the timer 103, and manages the internal time of the traffic information estimation device 100.

The wireless transmission and reception unit 208 corresponds to the wireless LAN 109, and communicates with the outside. In addition, the wireless transmission and reception unit 208 manages the network that is used for data communication between vehicles.

The input unit 209 corresponds to the input device 105, and receives an input from the outside.

Note that the above-mentioned hardware configuration for implementing each of the functions is merely an example, and the hardware configuration is not limited to the above-mentioned hardware configuration. For example, it may be configured that a plurality of processing circuits works together to implement each of the functions.

Next, an operation of the traffic information estimation device 100 will be explained, and also processing operation of a traffic information estimation method will be explained.

The traffic information estimation devices 100 are mounted on vehicles, respectively, and communicate with each other between vehicles that are present in a pre-specified specific section on the road, and as a result, an ad hoc network for sharing information is formed among the traffic information estimation devices. The specific section may be defined between installation positions of devices each of which transmits beacon signal and is installed at the side of the road. Alternatively, the specific section may be defined based on the installation positions of traffic signals, which can be obtained from map data stored in the external storage device 104.

Figure 3:
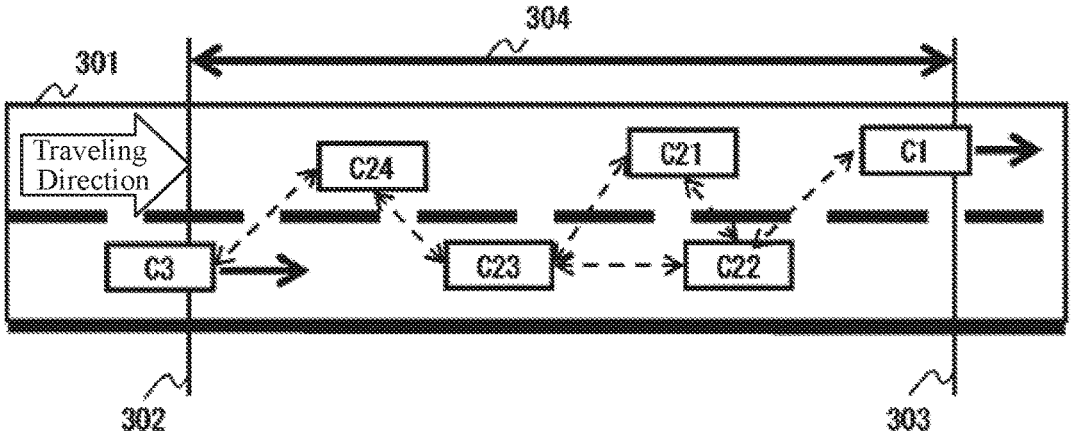
FIG. 3 is a diagram for schematically illustrating a state of vehicles traveling in a specific section in Embodiment 1.

FIG. 3 is a diagram for schematically illustrating a state of vehicles traveling in a specific section.

In FIG. 3, on the road 301 having two lanes on which vehicles are traveling from left to right, the specific section 304 is defined between a section start point 302 and a section end point 303 on the road 301. The vehicles C1, C21, C22, C23, C24, C3 are traveling on the road 301, performing vehicle-to-vehicle communication as indicated by dashed arrows in FIG. 3, and the vehicles in the specific section 304 form an ad hoc network. In addition, the vehicle C1 is in a state of leaving the specific section 304, and the vehicle C3 is in a state of entering the specific section 304.

Further, with reference to FIG. 3, it is assumed that the vehicles can transmit and receive data by the vehicle-to-vehicle communication as indicated by the dashed arrows, and share the same data among the plurality of vehicles.

Moreover, in FIG. 3, the vehicle C1 which leaves the specific section 304 discards data which was acquired in the specific section 304 and then leaves the specific section 304. To the vehicle C3 which enters the specific section 304, a vehicle near the vehicle C3, for example the vehicle C24, transmits shared data in the specific section 304 to the vehicle C3.

Figure 4:
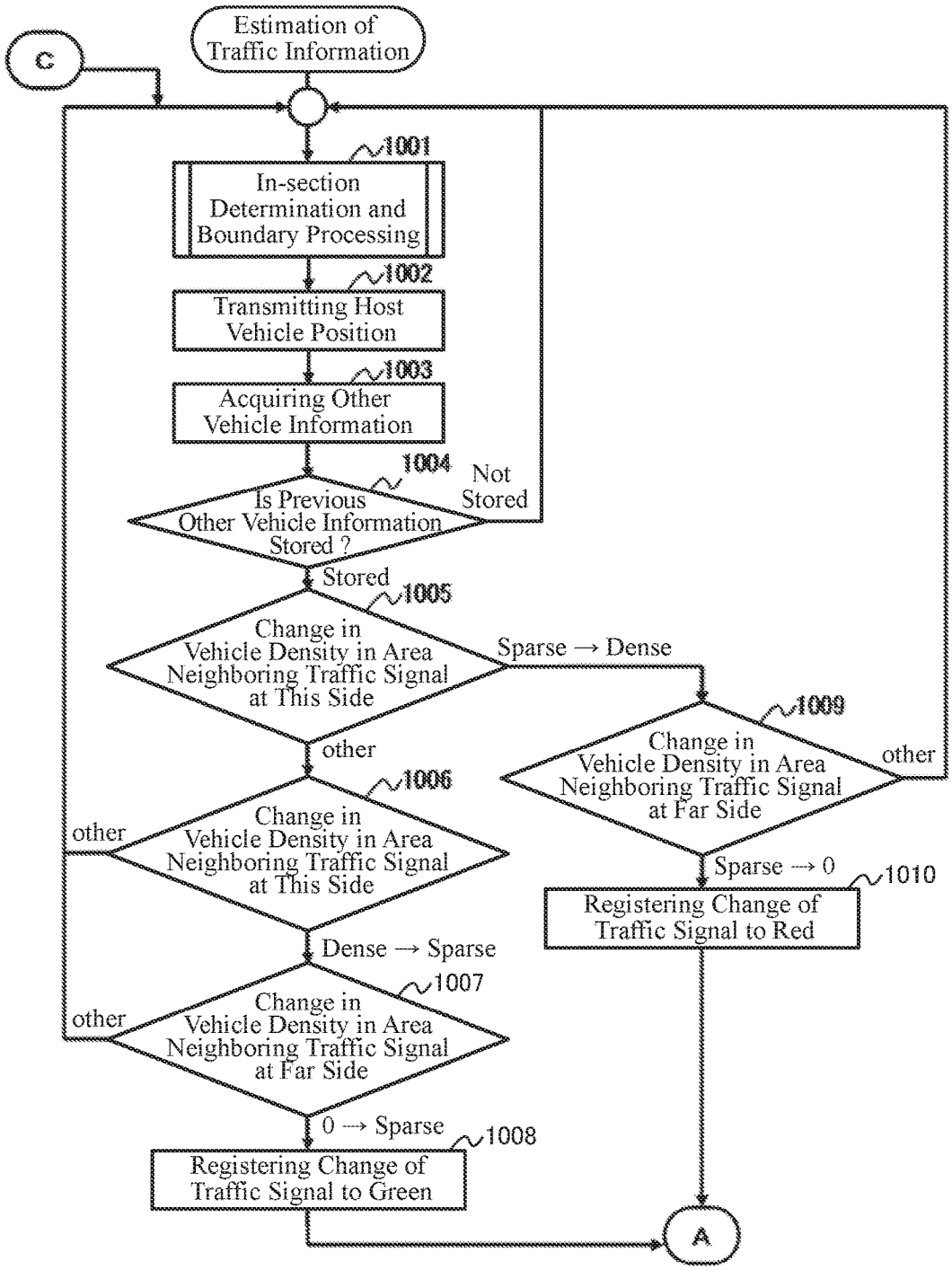
FIG. 4 is a flowchart for illustrating an operation of the traffic information estimation device 100 according to Embodiment 1.
Figure 5:
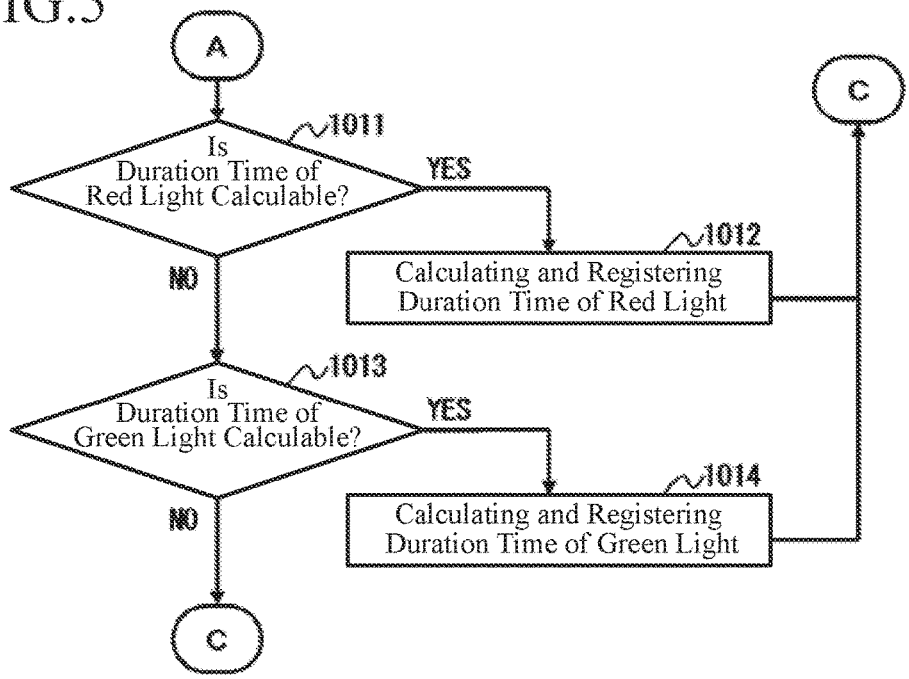
FIG. 5 is a flowchart for illustrating an operation of the traffic information estimation device 100 according to Embodiment 1.
Figure 6:
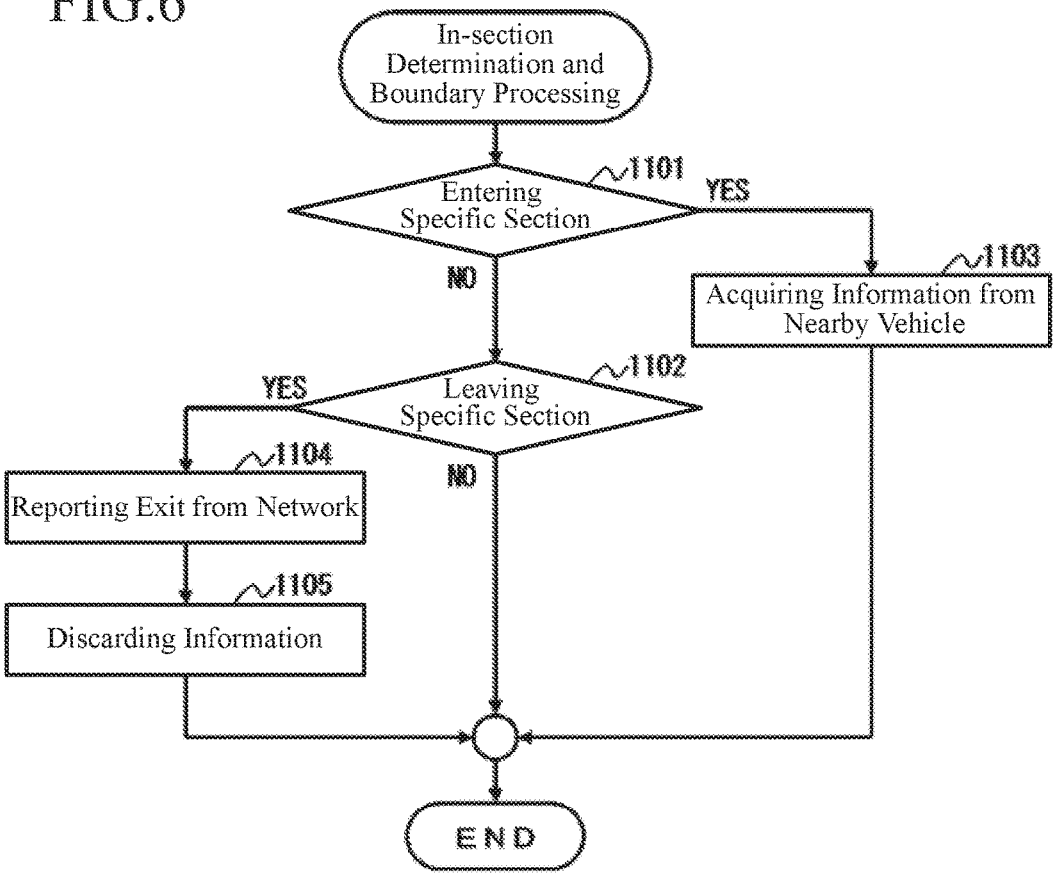
FIG. 6 is a flowchart for illustrating an operation of the traffic information estimation device 100 according to Embodiment 1.

FIG. 4, FIG. 5, and FIG. 6 are flowcharts for illustrating the operation of the traffic information estimation device 100 according to this embodiment. Note that the operation is not limited to that indicated by these flowcharts. The processes may be performed in an order different from the order indicated by the flowcharts and some processes may be performed at the same time as long as equivalent results can be obtained.

Firstly, in Step 1001, in-section determination and boundary processing are performed. At first, the section identification unit 201 determines whether the host vehicle entered a specific section (Step 1101). For example, the section identification unit 201 determines that the host vehicle entered the specific section when the beacon signal receiver 108 receives the beacon signal, which indicates entry into the specific section, from the device installed at the side of the road. Alternatively, for example, the section identification unit 201 determines that the host vehicle entered the specific section when it is shown that the host vehicle is present in the specific section based on matching of the position information of the host vehicle acquired by the GPS 106 with the map data including specific section information stored in the external storage device 104.

When the section identification unit 201 determines that the host vehicle entered a specific section (Step 1101: YES), the wireless transmission and reception unit 208 communicates with another vehicle by vehicle-to-vehicle communication and acquires information stored in the other vehicle (Step 1103). The information stored in the other vehicle is, for example, an information table including distribution data, which includes the position information indicating the position of the vehicle and the time information indicating the time point at which the vehicle was present at the position, time information indicating a time at which the traffic signal is switched, and the display change cycle of the traffic signal.

When the section identification unit 201 does not determine that the host vehicle entered the specific section (Step 1101: NO), the section identification unit 201 determines whether the host vehicle leaves the specific section (Step 1102). For example, the section identification unit 201 determines that the host vehicle leaves the specific section when the beacon signal receiver 108 receives the beacon signal, which indicates exit from the specific section, from the device installed at the side of the road. Alternatively, for example, the section identification unit 201 determines that the host vehicle leaves the specific section when it is shown that the host vehicle is present at the vicinity of the boundary from inside the specific section to the outside the specific section based on matching of the position information of the host vehicle acquired by the GPS 106 with the map data including the specific section information stored in the external storage device 104.

When the section identification unit 201 determines that the host vehicle leaves the specific section (Step 1102: YES), exit from the network is declared to the network (Step 1104), and the information acquired in the specific section is discarded (Step 1105). In declaring exit from the network, the wireless transmission and reception unit 208 communicates with another vehicle, and transmits information indicating the exit from the network to the vehicle. The information that was acquired in the specific section is, for example, distributed data, or the information table including the time information indicating the time at which the traffic signal is switched and the display change cycle of the traffic signal.

In Step 1001, when the section identification unit 201 determines that the host vehicle entered the specific section, a process from Step 1102 is performed.

At first, the host-vehicle information generation unit 202 generates the distribution data of the host vehicle. Then, the wireless transmission and reception unit 208 performs vehicle-to-vehicle communication, and transmits the generated distribution data to another vehicle (Step 1002). The distribution data includes the position information indicating the position of the host vehicle that is acquired by the GPS 106 and the time information indicating the time at which the host vehicle was present at the position. In addition, the distribution data includes an identifier of the wireless LAN 109. The host-vehicle information generation unit 202 generates the distribution data including the position information, the time information, and the identifier. Then, the wireless transmission and reception unit 208 transmits the distribution data to the network on which the other vehicle is present.

Further, the wireless transmission and reception unit 208 receives the distribution data distributed from another vehicle, and the other-vehicle information acquisition unit 203 stores the received distribution data (Step 1003). Note that it is configured that each of the vehicles transmits the distribution data at a constant time interval (for example, every 1 second).

The other-vehicle information acquisition unit 203 determines whether the previous distribution data received from the other vehicle is stored (Step 1004). When the previous distribution data is not stored (Step 1004: "NOT STORED"), the process returns to Step 1001. When the previous distribution data is stored (Step 1004: "STORED"), the process proceeds to Step 1005.

Figures 7, 8:
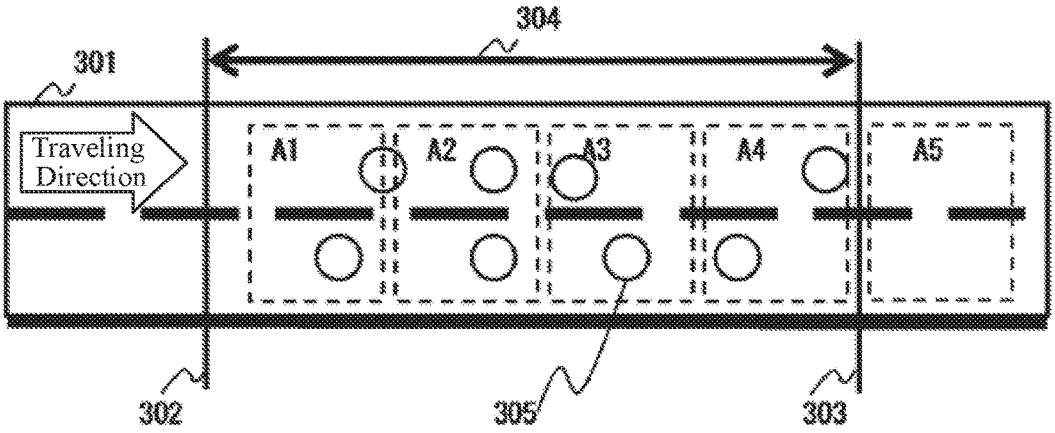
FIG. 7 is a table for illustrating an example of distribution data in Embodiment 1.
FIG. 8 is a diagram for illustrating an example of arrangement of vehicles in Embodiment 1.

FIG. 7 is a table for illustrating an example of the distribution data stored in the other-vehicle information acquisition unit 203.

In FIG. 7, the distribution data 401 includes the identifier 402, position information 403, and time information 404. The identifier 402 is used for identifying each of the vehicles. As the identifier 402, MAC address (Media Access Control address) or the like of the wireless LAN, which is installed on the vehicle, can be used. The position information 403 indicates the positions of the vehicles. The time information 404 indicates the time points at which the vehicles were at the positions.

The distribution data transmitted from each of the vehicles are communicated with a plurality of the vehicles forming the ad hoc network, stored in each of the plurality of vehicles, and as a result, shared in the network.

Next, the vehicle group state determination unit 205 determines the change in the density of vehicles on the road by using the distribution data stored in the other-vehicle information acquisition unit 203 (Steps 1005 to 1007, and Step 1009). By using the determination results, the traffic information calculation unit 206 registers the time at which the traffic signal is switched based on the time interval of the change in the density of vehicles (Step 1008, Step 1010).

With reference to the drawings, the processes performed in Steps 1005 to 1010 will be explained.

FIG. 8 is a diagram for illustrating an example of an arrangement of vehicles.

In the example shown in FIG. 8, each of the vehicle positions at a certain time is arranged on the road 301. In FIG. 8, a circle represents a vehicle 305. The position of each vehicle can be indicated by a point on a two-dimensional plane, and the arrangement of the vehicles can be recognized as a formation constituted by the vehicles 305. That is, the arrangement of the vehicles can be recognized as the formation of a vehicle group. In addition, a dynamic change of the formation can be grasped by comparing formations at different time points to each other. Further, in a case in which the road 301 is divided into areas, for example, areas A1 to A5, the density of vehicles in each of the areas can be calculated based on the number of vehicles included in each of the areas. The more the number of the vehicles in an area is, the higher the density of vehicles in the area becomes. The density of vehicles can be considered as a congestion degree of vehicles. The density of vehicles can be calculated based on a distance between vehicles. In this case, the smaller the distance between most adjacent vehicles is, the higher the density of vehicles becomes.

The arrangement of the vehicles shown in FIG. 8 can be acquired by the other-vehicle information acquisition unit 203. It is assumed that the distribution data distributed from other vehicles are consistent in time information with each other by synchronization processing performed by the timer 103. The other-vehicle information acquisition unit 203 acquires the position of each vehicle at a certain time point based on the position information and the time information. Then, the other-vehicle information acquisition unit 203 acquires the arrangement of vehicles at the certain time point by mapping each of the vehicles on the road 301. In addition, the other-vehicle information acquisition unit 203 acquires the arrangement of vehicles at a different time point to the above-mentioned certain time point based on the distribution data which are acquired at a plurality of times. By acquiring the arrangement of vehicles at a plurality of time points, the other-vehicle information acquisition unit 203 acquires the arrangement information indicating an arrangement of vehicles in accordance with a time passage.

In Steps 1005 to 1007 and Step 1009, the vehicle group state determination unit 205 determines the change in the density of vehicles.

Figure 9:
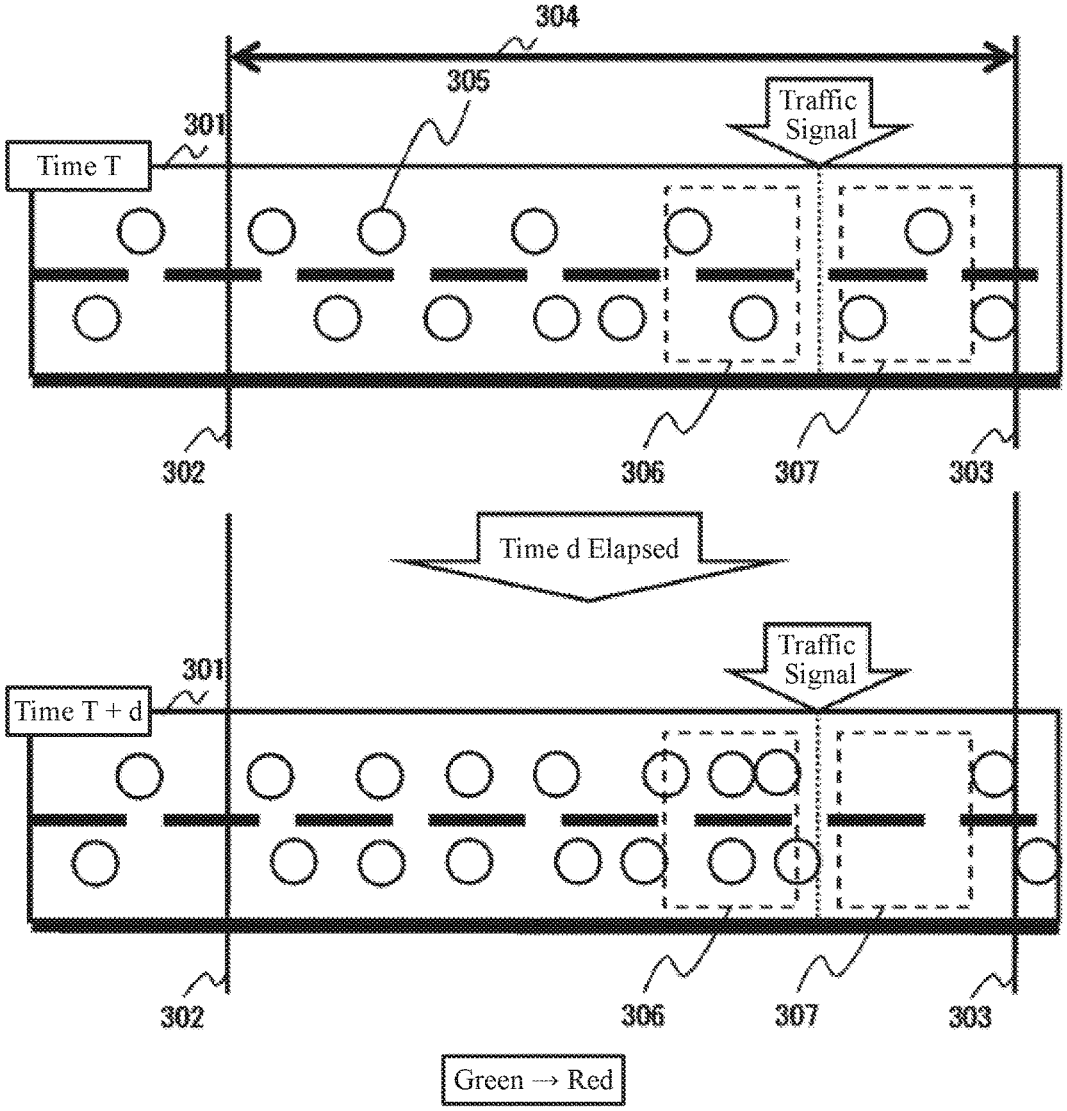
FIG. 9 is a diagram for illustrating arrangement states of vehicles in Embodiment 1.

FIGS. 9A and 9B are diagrams for illustrating arrangement states of vehicles including an arrangement state at a time point T and an arrangement state at a time point T+d. It is assumed that the traffic signal is installed between an area 306 and an area 307.

In FIGS. 9A and 9B, the change from the arrangement at the time point T to the arrangement at the time point T+d is shown, in which the density of vehicles in the area 306 neighboring the traffic signal at this side is changed from sparse to dense, and the density of vehicles in the area 307 neighboring the traffic signal at far side is changed from sparse to zero The vehicle group state determination unit 205 determines such a change in the density of vehicles around an installation position of the traffic signal ("sparse to dense" in Step 1005, "sparse to zero" in Step 1009). In a case in which the density of vehicles in the area 306 neighboring the traffic signal at this side is changed from sparse to dense and the density of vehicles in the area 307 neighboring the traffic signal at far side is changed from sparse to zero, the traffic information calculation unit 206 determines that the traffic signal is switched to red, and registers the result of the determination together with the time information (Step 1010).

FIGS. 10A and 10B are diagrams for illustrating arrangement states of the vehicles including an arrangement state at a time point T and an arrangement state at a time point T+d. It is assumed that the traffic signal is installed between the area 306 and the area 307.

Figure 10:
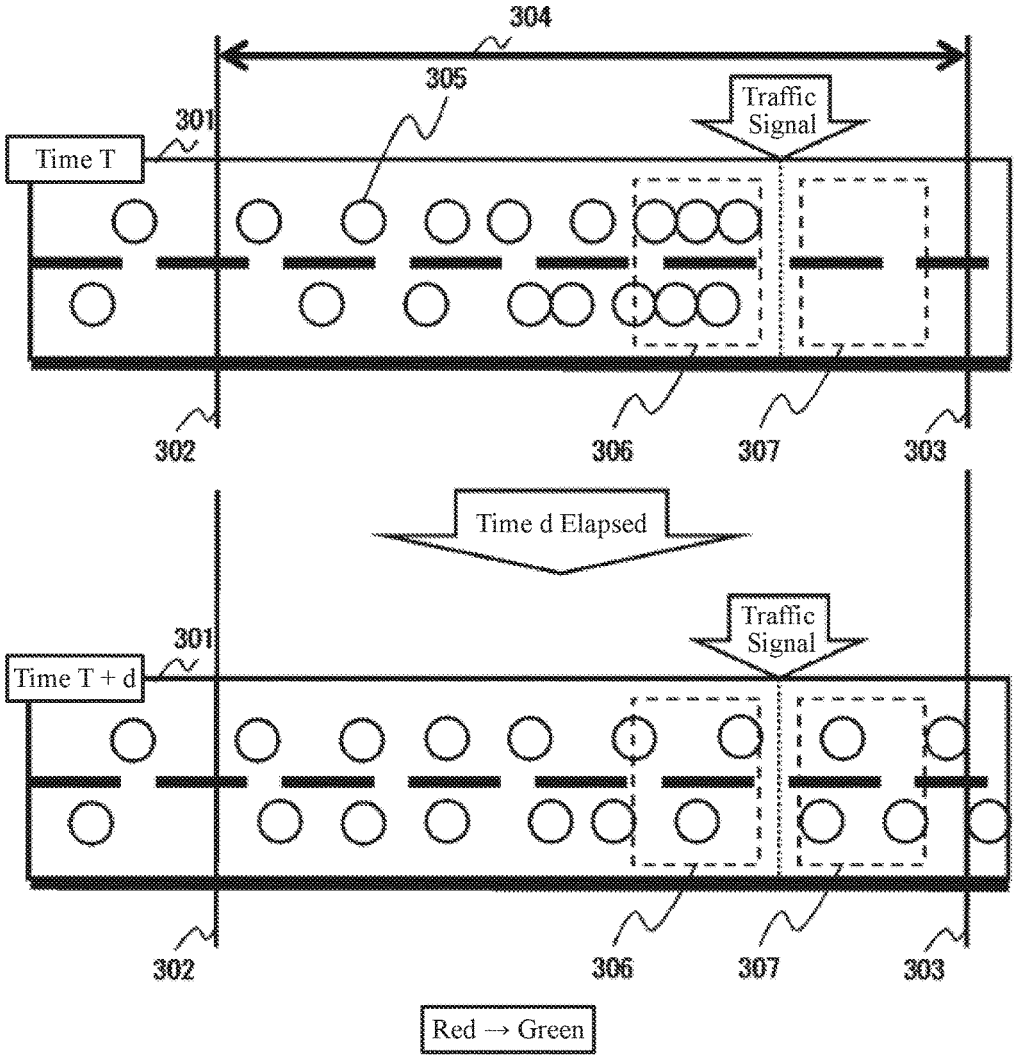
FIG. 10 is a diagram for illustrating arrangement states of vehicles in Embodiment 1.

In FIG. 10, the change from the arrangement at the time point T to the arrangement at the time point T+d is shown, in which the density of vehicles in the area 306 neighboring the traffic signal at this side is changed from dense to sparse, and the density of vehicles in the area 307 neighboring the traffic signal at far side is changed from zero to sparse.

The vehicle group state determination unit 205 determines such a change in the density of vehicles around the installation position of the traffic signal ("dense to sparse" in Step 1006, "zero to sparse" in Step 1007). In a case in which the density of vehicles in the area 306 neighboring the traffic signal at this side is changed from dense to sparse and the density of vehicles in the area 307 neighboring the traffic signal at far side is changed from zero to sparse, the traffic information calculation unit 206 determines that the traffic signal is switched to green, and registers the result of the determination together with the time information (Step 1008).

Note that the vehicle group state determination unit 205 uses a threshold value in determining whether the density is sparse or dense. For example, when the number of vehicles existing in an area is greater than a predetermined threshold value A, the vehicle group state determination unit 205 determines that the density is "dense". On the other hand, when the number of vehicles existing in the area is equal to or less than the predetermined threshold value A, the vehicle group state determination unit 205 determines that the density is "sparse". Alternatively, in a case where the determination of the density is performed based on the distance between vehicles, when the shortest distance between vehicles is smaller than a predetermined threshold value B, the vehicle group state determination unit determines that the density is "dense". On the other hand, when the shortest distance between vehicles is equal to or larger than the predetermined threshold value B, the vehicle group state determination unit determines that the density is "sparse". In addition, when the determination based on the threshold value is switched, the vehicle group state determination unit 205 determines that the change in the density occurs, and determines whether the density is changed or not.

Note that, the determination of the density is not limited to the 3 level ratings "sparse", "dense" and "zero", and may be performed based on 2 level ratings "sparse" and "dense".

FIGS. 11A to 11C are tables for illustrating relationship between changes in the density of vehicles and display changes in a traffic signal. FIG. 11A is a table for illustrating density states determined by the vehicle group state determination unit 205 and time points at which each state occurs. FIG. 11B is a table for illustrating changes in a traffic signal determined by the traffic information calculation unit 206 and the time points at which each state occurs. FIG. 11C is a table for illustrating display change cycles of a traffic signal, which indicates a switching period of the traffic signal display, determined by the traffic information calculation unit 206.

As described above, in Steps 1005 to 1007 and Step 1009, the vehicle group state determination unit 205 determines the information shown in FIG. 11A. Then, in Step 1008 and Step 1010, the traffic information calculation unit 206 registers information shown in FIG. 11B in an information table in the traffic information calculation unit 206. Information shown in FIG. 11C is calculated by the traffic information calculation unit 206 in subsequent steps as the display change cycles of the traffic signal, and is registered in the information table in the traffic information calculation unit 206.

After registering changes in the traffic signal and the time points at which the changes occur as shown in FIG. 11B, the traffic information calculation unit 206 determines whether the duration time of the red light is calculable based on the registered information in the information table (Step 1011). As shown in FIG. 11B, when the information indicating that the traffic signal changes from green to red and changes from red to green again exists, the traffic information calculation unit 206 determines that the duration time of the red light is calculable. More specifically, when both the information indicated by the sequence number "1" and "2" exist, or when both the information indicated by the sequence number "3" and "4" exist, it is determined that the duration time of the red light is calculable.

When the traffic information calculation unit 206 determines that the duration time of the red light is calculable (Step 1011: YES), the traffic information calculation unit 206 calculates the duration time of the red light as the display change cycle, which indicates a switching period of a traffic signal display, using the information which indicates the occurrence time registered in the information table, and updates the information table (Step 1012).

When the traffic information calculation unit 206 determines that the duration time of the red light is not calculable (Step 1011: NO), the traffic information calculation unit 206 determines whether the duration time of the green light is calculable based on the registered information in the information table (Step 1013). As shown in FIG. 11B, when the information indicating that the traffic signal changes from red to green and changes from green to red again exists, the traffic information calculation unit 206 determines that the duration time of the green light is calculable. More specifically, when both the information indicated by the sequence number "2" and "3" exist, the traffic information calculation unit determines that the duration time of the green light is calculable.

When the traffic information calculation unit 206 determines that the duration time of the green light is calculable (Step 1013: YES), the traffic information calculation unit 206 calculates the duration time of the green light as the display change cycle, which indicates a switching period of a traffic signal display, using the information which indicates the occurrence time registered in the information table, and updates the information table (Step 1014).

After that, the process returns to Step 1001, and the processes are repeatedly executed.

As described above, in a case where the traffic signal changes from green to red and from red to green again while one vehicle is present in a specific section, it is possible to calculate the duration time of the red light. Similarly, in a case where the traffic signal changes from red to green and from green to red again while one vehicle is present in a specific section, it is possible to calculate the duration time of the green light.

However, in a case where the traffic signal changes only once or the traffic signal does not change while one vehicle is present in the specific section, it is impossible to calculate the duration time of the traffic signal based only on the distribution data received by the vehicle while the vehicle is present in the specific section.

Thus, in such a case, when the vehicle enters the specific section, the vehicle acquires the information table, in which information is accumulated by other vehicles so far, from another vehicle in Step 1103. Then, the duration time of the traffic signal display is calculated using the acquired information table. That is, the vehicle that participates newly in the ad hoc network acquires the information table from a vehicle that has already participated in the ad-hoc network. Consequently, the vehicle that participates newly in the ad hoc network can share the information.

For example, in the case shown in FIG. 3, when the vehicle C3 enters a specific section, the vehicle C3 acquires the information table accumulated in the vehicle C24 from the vehicle C24 which has been already present in the specific section and exists near the vehicle C3.

Thus, by acquiring the information table in which the information is accumulated by other vehicles and calculating the duration time of the traffic signal based on the information table, it is possible to use information that was communicated before the vehicle enters the specific section. As a result, even in the case in which the traffic signal changes only once or the traffic signal does not change while the vehicle is present in the specific section, it is possible to calculate the display cycle of the traffic signal, which indicates the switching period of a traffic signal display.

Note that, in the case shown in FIGS. 11A to 11C, information shown in FIG. 11B and FIG. 11C is registered in the information table. The traffic information calculation unit 206 can calculate the display change cycle as long as the time information shown in FIG. 11B, which indicates the time points at which the traffic signal changes, can be acquired. Further, even when the information table is not acquired, the traffic information calculation unit 206 can calculate the display change cycle as long as the distribution data can be acquired.

The display change cycle of the traffic signal calculated by the traffic information calculation unit 206 is displayed on the information display unit 204 such that the driver of the host vehicle can visibly recognize it. Further, the following configuration may be adopted: for example, in cooperation with a car navigation device mounted on the vehicle, the CPU 101 calculates a recommended speed based on the display change cycle in accordance with the distance between the host vehicle and the traffic signal and the time until the traffic signal ahead of the host vehicle changes, and the information display unit 204 displays the recommended speed.

As described above, according to this embodiment, the arrangement information indicating the arrangement of vehicles in accordance with a time passage on the road on which a traffic signal is installed is acquired by using the position information indicating the positions of the vehicles and the time information indicating the time points at which the vehicles were present at the positions, wherein the position information and the time information are included in the distribution data received from another vehicle. Changes in the density of vehicles are determined using the arrangement information. The display change cycle, which indicates the switching period of a traffic signal display, is calculated based on the time interval between the changes. Consequently, tracing of a traveling state of a particular target vehicle is not required, and as a result, it is possible to simplify the processing for estimating the change cycle of the traffic signal as compared to conventional techniques.

In addition, in this embodiment, it is determined that the traffic signal changes to red when the density of vehicles in the area 307 neighboring the traffic signal at far side is changed from sparse to zero as well as the density of vehicles in the area 306 neighboring the traffic signal at this side is changed from sparse to dense. That is, it is determined that a traffic signal changes to red when the density of vehicles traveling toward the traffic signal is changed from sparse to dense and the density of vehicles traveling away from the traffic signal is changed from dense to sparse. As a result, it is possible to estimate the time at which the traffic signal changes to red. Thus, it is possible to estimate the display change cycle of the traffic signal for each color of the traffic signal.

Further, according to this embodiment, it is determined that the traffic signal changes to green when the density of vehicles in the area 307 neighboring the traffic signal at far side is changed from zero to sparse as well as the density of vehicles in the area 306 neighboring the traffic signal at this side is changed from dense to sparse. That is, it is determined that the traffic signal changes to green when the density of vehicles traveling toward the traffic signal is changed from dense to sparse and the density of vehicles traveling away from the traffic signal is changed from zero to sparse. As a result, it is possible to estimate the time at which the traffic signal changes to green. Thus, it is possible to estimate the display change cycle for each color of the traffic signal.

Furthermore, in this embodiment, distribution data including the position information indicating the position of the host vehicle and the time information indicating the time at which the host vehicle was present at the position are generated, and the generated distribution data are transmitted. According to such a configuration, it is possible to share the distribution data among the vehicles forming the ad hoc network. Thus, it is possible to estimate the display change cycle based on the shared distribution data.

Note that, in this embodiment, the following case is explained: the other-vehicle information acquisition unit 203 acquires the arrangement information indicating the arrangement of vehicles in accordance with a time passage on the road on which a traffic signal is installed based on the position information indicating the positions of the vehicles and the time information indicating the time points at which the vehicles were present at the positions, wherein the position information and the time information are included in the distribution data received from another vehicle. However, the way of acquiring the arrangement information is not limited to the above-described example. The arrangement information may be any type of information as long as the information indicates the arrangement of vehicles in accordance with a time passage on the road on which the traffic signal is installed. For example, it may be configured that vehicles on a road on which a traffic signal is installed are imaged multiple times by a camera capable of imaging the vehicles on the road. In this case, the other-vehicle information acquisition unit 203 may extract the arrangement information indicating the arrangement of vehicles in accordance with a time passage based on the plurality of images.

In addition, in this embodiment, the following case is explained: it is determined that the traffic signal changes to red when the density of vehicles in the area 307 neighboring the traffic signal at far side is changed from sparse to zero as well as the density of vehicles in the area 306 neighboring the traffic signal at this side is changed from sparse to dense. However, a way of determining whether the traffic signal changes to red is not limited to such an example. For example, it may be determined that the traffic signal changes to red when either one of the following condition is satisfied: the density of vehicles in the area 306 neighboring the traffic signal at this side is changed from sparse to dense; or the density of vehicles in the area 307 neighboring the traffic signal at far side is changed from sparse to zero. That is, it may be determined that the traffic signal changes to red when either one of the following condition is satisfied: the density of vehicles traveling toward the traffic signal is changed from sparse to dense; or the density of vehicles traveling away from the traffic signal is changed from dense to sparse.

Similarly, concerning a way of determining whether the traffic signal changes to green, it may be determined that the traffic signal changes to green when either one of the following condition is satisfied: the density of vehicles traveling toward the traffic signal is changed from dense to sparse; or the density of vehicles traveling away from the traffic signal is changed from sparse to dense.

Further, in this embodiment, the case in which the information display unit 204 displays the recommended speed based on the display change cycle of the traffic signal is explained. However, functions of the control unit corresponding to the information display unit 204 are not limited to the above-described example. The control unit may be any type of unit as long as it controls a device mounted on a vehicle traveling on a road on which a traffic signal is installed based on the display change cycle of the traffic signal. For example, the control unit may control a device that controls a motion of a vehicle body such as an accelerator and a brake based on the display change cycle of the traffic signal.

Embodiment 2

In Embodiment 1, the display change cycle of the traffic signal, which indicates the switching period of a traffic signal display, is estimated based on the changes in the density of vehicles traveling in the same direction as the host vehicle. Alternatively, the display change cycle of the traffic signal for the lane on which the host vehicle is traveling may be estimated based on changes in the density of vehicles traveling on the opposite lane across an intersection.

The hardware configuration and the block diagram for illustrating a functional configuration of the traffic information estimation device 100 according to Embodiment 2 are the same as those in Embodiment 1, so that the explanation thereof will be omitted.

Note that the arrangement information acquired by the other-vehicle information acquisition unit 203 indicates an arrangement of vehicles in accordance with a time passage on the opposite lane of the road on which a traffic signal is installed and on which the host vehicle is traveling. Further, the vehicle group state determination unit 205 determines changes in the density of vehicles on the opposite lane using the arrangement information. Moreover, the traffic information calculation unit 206 calculates the display change cycle of a traffic signal installed on the road on which the host vehicle is traveling based on a time interval between the changes in the density of vehicles on the opposite lane.

Figure 12:
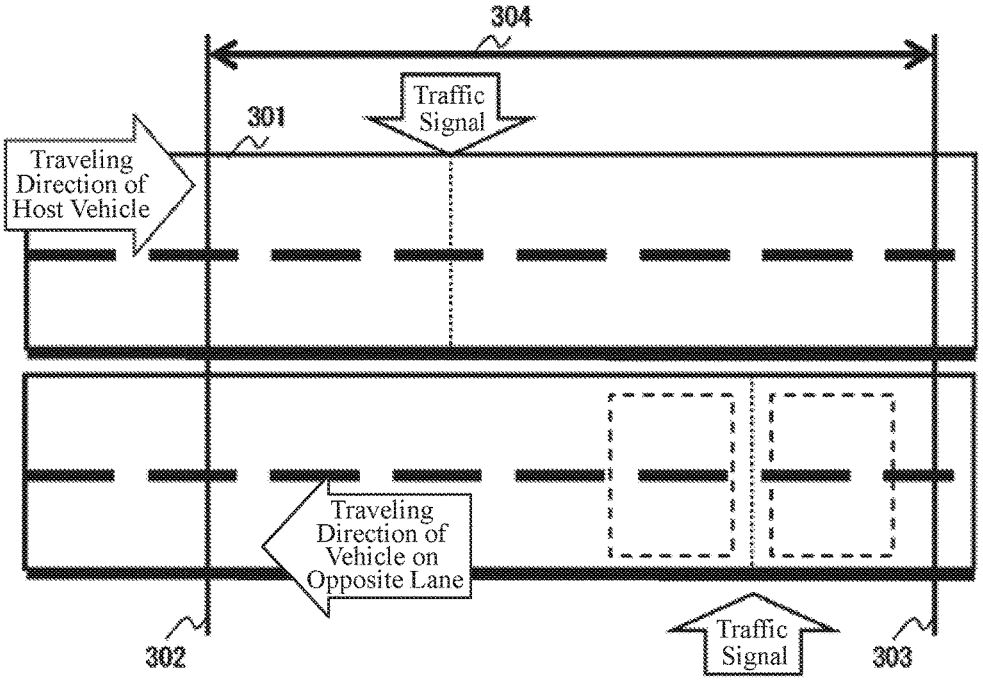
FIG. 12 is a diagram for illustrating an example of an arrangement of vehicles in Embodiment 2.

FIG. 12 is a diagram for illustrating an example of an arrangement of vehicles traveling on one lane and vehicles traveling on the opposite lane.

In FIG. 12, the specific section 304 is set to both the one lane and the opposite lane. The vehicles in the specific section 304 form an ad hoc network, and share the information in the same manner as Embodiment 1.

The vehicle group state determination unit 205 determines the change in the density of vehicles on the opposite lane using the distribution data regarding the vehicle travelling on the opposite lane stored in the other-vehicle information acquisition unit 203. Since the distribution data include the position information indicating the positions of the vehicles, it is possible to determine whether a vehicle is traveling on the opposite lane or on the same lane as the host vehicle by matching the position information with the map data. Alternatively, it is possible to determine whether the vehicle is traveling on the opposite lane or on the same lane by, for example, measuring the temporal variation of the vehicle position.

With the linkage between the timing at which a traffic signal for a lane changes and the timing at which a traffic signal for the opposite lane changes, the vehicle group state determination unit 205 determines that the traffic signal on the lane on which the host vehicle is traveling is switched to red when the density of vehicles that are on the opposite lane and that are traveling toward the traffic signal is changed from sparse to dense or when the density of vehicles that are on the opposite lane and that are traveling away from the traffic signal is changed from dense to sparse. On the other hand, the vehicle group state determination unit 205 determines that the traffic signal for the lane on which the host vehicle is traveling is switched to green when the density of vehicles that are on the opposite lane and that are traveling toward the traffic signal is changed from dense to sparse or when the density of vehicles that are on the opposite lane and that are traveling away from the traffic signal is changed from sparse to dense.

Then, the traffic information calculation unit 206 calculates the display change cycle of the traffic signal on the road on which the host vehicle is traveling based on the time interval between changes in the density of vehicles on the opposite lane.

As described above, in this embodiment, the change in the density of vehicles on the opposite lane is determined by using the arrangement information indicating the arrangement of vehicles in accordance with a time passage on the lane opposite to the lane on which the traffic signal is installed and on which the host vehicle is traveling, and the display change cycle of the traffic signal on the road on which the host vehicle is traveling is calculated based on the time interval between the changes in the density of vehicles on the opposite lane. Consequently, even when the number of vehicles traveling on the same lane as the host vehicle is too few to measure the density of vehicles traveling on the same lane, it is possible to estimate the change cycle of the traffic signal.

Further, in this embodiment, it is determined that the traffic signal on the lane on which the host vehicle is traveling is switched to red when the density of vehicles that are on the opposite lane and that are traveling toward the traffic signal is changed from sparse to dense or when the density of vehicles that are on the opposite lane and that are traveling away from the traffic signal is changed from dense to sparse. Consequently, even when the number of vehicles traveling on the same lane as the host vehicle is too few to measure the density of vehicles traveling on the same lane, it is possible to estimate the time at which the traffic signal changes to red. Thus, it is possible to estimate the display change cycle for each color of the traffic signal.

Moreover, in this embodiment, the vehicle group state determination unit determines that the traffic signal for the lane on which the host vehicle is traveling is switched to green when the density of vehicles that are on the opposite lane and that are traveling toward the traffic signal is changed from dense to sparse or when the density of vehicles that are on the opposite lane and that are traveling away from the traffic signal is changed from sparse to dense. Consequently, even when the number of vehicles traveling on the same lane as the host vehicle is too few to measure the density of vehicles traveling on the same lane, it is possible to estimate the time at which the traffic signal changes to green. Thus, it is possible to estimate the display change cycle for each color of the traffic signal.

Embodiment 3

In the aforementioned Embodiment 1, it is configured that the display change cycle of the traffic signal, which indicates the switching period of a traffic signal display, is estimated based on the changes in the density of vehicles traveling in the same direction as the host vehicle. Alternatively, it may be configured that the display change cycle of the traffic signal for the lane on which the host vehicle is traveling is estimated based on changes in the density of vehicles traveling on a road intersecting the road on which the host vehicle is traveling at the intersection.

In this embodiment, a hardware configuration and a block diagram for illustrating a functional configuration of a traffic information estimation device 100 are the same as those in Embodiment 1, so that explanation thereof will be omitted.

Note that, the arrangement information acquired by the other-vehicle information acquisition unit 203 indicates an arrangement of vehicles in accordance with a time passage on the road intersecting the road on which a traffic signal is installed and on which the host vehicle is traveling. Further, the vehicle group state determination unit 205 determines changes in the density of vehicles on the road intersecting the road on which the host vehicle is traveling using the arrangement information. Furthermore, the traffic information calculation unit 206 calculates the display change cycle of the traffic signal installed on the road on which the host vehicle is traveling based on a time interval between the changes in the density of vehicles on the road intersecting the road on which the host vehicle is traveling.

Figure 13:
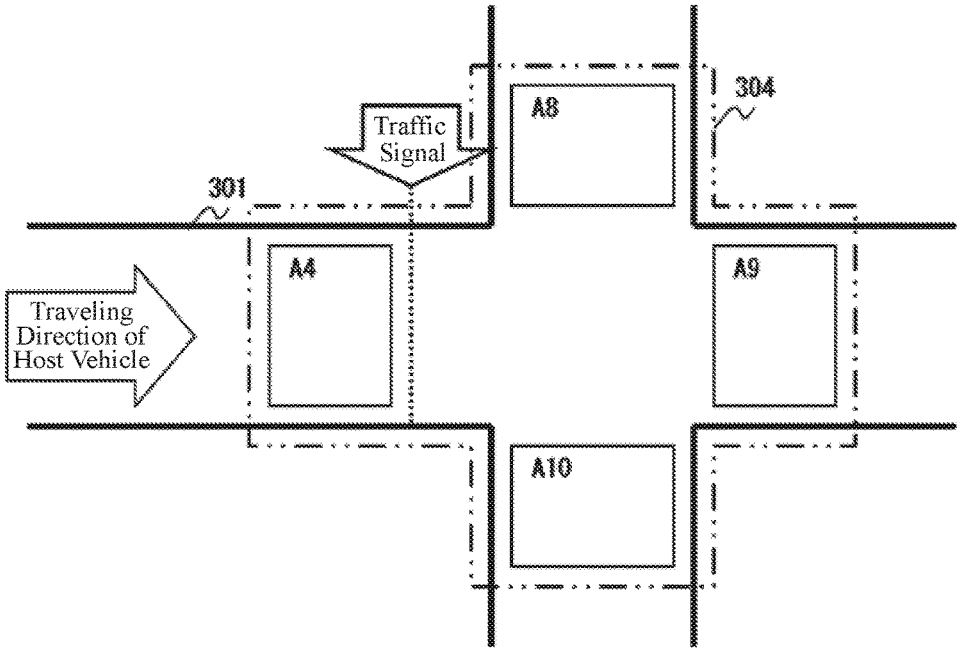
FIG. 13 is a diagram for illustrating an example of an arrangement of vehicles in Embodiment 3.

FIG. 13 is a diagram for illustrating an example of an arrangement of vehicles traveling on one lane and vehicles traveling on a lane intersecting the one lane.

In FIG. 13, the specific section 304 is set to both one road on which the traffic signal is installed and on which the host vehicle is traveling and another road that intersects the one road. The vehicles in the specific section 304 form an ad hoc network, and share information in the same manner as Embodiment 1.

The vehicle group state determination unit 205 determines a change in the density of vehicles on each of the roads that intersect each other at the intersection using the distribution data stored in the other-vehicle information acquisition unit 203, wherein the distribution data include data received from a vehicle travelling on the road on which the host vehicle is traveling and data received from a vehicle travelling on another road that intersects the road on which the host vehicle is traveling. Since the distribution data include the position information indicating the positions of the vehicles, it is possible to determine on which road, among the roads intersecting each other at the intersection, the vehicle from which the distribution data are received is traveling by matching the position information with the map data. Alternatively, it is possible to determine on which road, among the roads intersecting each other at the intersection, the vehicle from which the distribution data are received is traveling by, for example, measuring a temporal variation in vehicle position to determine the traveling direction of the vehicle.

When the density of vehicles on a road being a branch of the road on which the host vehicle is traveling is changed from sparse to dense, the vehicle group state determination unit 205 determines that the traffic signal that controls the traffic to the branch road is switched to green.

For example, in FIG. 13, when the density of vehicles in the area A10 is changed from sparse to dense, it is determined that the display of the traffic signal to turn right for the lane on which the host vehicle is traveling changes to green. In this case, when the density of vehicles is kept in a sparse state in both the area A8 and the area A9, the vehicle group state determination unit determines that the traffic signal for the lane on which the host vehicle is traveling is switched to a state indicating permission of the right turn-only. Similarly, the change in the density of vehicles in each of the areas A4, A8 to A10 is determined.

Then, the traffic information calculation unit 206 calculates the display change cycle of the traffic signal on the road on which the host vehicle is traveling based on a time interval between the changes in the density of vehicles on the road intersecting the road on which the host vehicle is traveling. At this time, each display change cycle of the traffic signal that controls the traffic from the road on which the host vehicle is traveling to each of the intersecting roads is calculated.

As described above, in this embodiment, the change in the density of vehicles on the road intersecting the road on which the host vehicle is traveling is determined using the arrangement information indicating the arrangement of vehicles in accordance with a time passage on the road intersecting the road on which a traffic signal is installed and on which the host vehicle is traveling; and the display change cycle of the traffic signal on the road on which the host vehicle is traveling is calculated based on the time interval between the changes in the density of vehicles on the road intersecting the road on which the host vehicle is traveling. Consequently, it is possible to estimate each of the display change cycles of the traffic signal that controls the traffic from the road on which the host vehicle is traveling to each of the roads intersecting the road on which the host vehicle is traveling.

Embodiment 4

In Embodiment 1 mentioned before, a preceding vehicle supplies information to a subsequent vehicle that newly enters a specific section. On the other hand, it may be configured that data is temporary stored in a traffic information estimation device 100 of a vehicle that is parked at an adjacent area in the specific section. According to such a configuration, it is possible to continuously supply information even when subsequent vehicles become temporarily absent in the specific section.

In this embodiment, a hardware configuration and a block diagram for illustrating a functional configuration of a traffic information estimation device 100 are the same as those in Embodiment 1, so that explanation thereof will be omitted.

For example, it is configured that the specific section is set so as to include an adjacent parking area, and the ad hoc network is formed by the vehicles including a vehicle that is parked at the adjacent parking area. Since the information is shared among the vehicles forming the ad hoc network, the vehicle that is parked at the adjacent parking area also shares the information. After that, even when there are temporarily no vehicles that are traveling in the specific section of the road, the vehicle that is parked at the adjacent parking area retains the information. After that, when a vehicle newly enters the specific section, the ad hoc network is formed by the vehicles including the newly entered vehicle and the vehicle parked at the adjacent parking area. Thus, the information which has been retained in the vehicle parked at the adjacent parking area is shared among the vehicles forming the ad hoc network.

As described above, in this embodiment, the specific section is set so as to include an adjacent parking area, and the ad hoc network is formed to include not only travelling vehicles but also a vehicle parked at the adjacent parking area. Consequently, even when there are temporarily no vehicles that are traveling in the specific section of the road, it is possible for the vehicle that newly enters the specific section to share the information which was shared by the vehicles traveling in the specific section in the past.

Embodiment 5

In Embodiment 1 described before, the change in the traffic signal is determined based on the change in the density of vehicles in one specific section. Alternatively, it may be configured that the host vehicle acquires traffic information of a specific section farther than the specific section in which the host vehicle is traveling via information communication across a plurality of the specific sections.

In this embodiment, a hardware configuration and a block diagram for illustrating a functional configuration of a traffic information estimation device 100 are the same as those in Embodiment 1, so that explanation thereof will be omitted.

Figure 14:
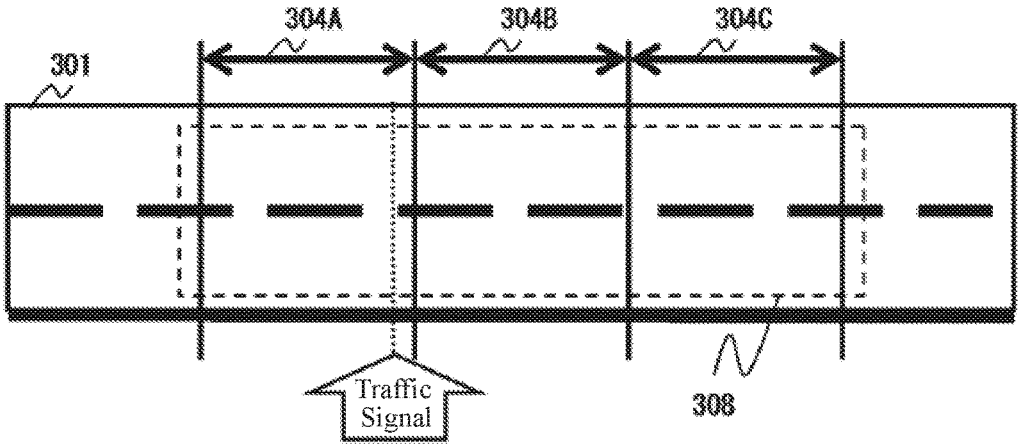
FIG. 14 is a diagram for illustrating a relationship between specific sections and an area for determining changes of traffic signal.

FIG. 14 is a diagram for illustrating a relationship between a specific section and areas used for determining the change in the traffic signal.

In Embodiment 1, as shown in FIGS. 9A and 9B, the change in the traffic signal is determined based on the change in the density of vehicles in the area 306 and the area 307 that are set in the specific section 304.

In this embodiment, an area 308 used for determining the change in the traffic signal is set such that the area 308 includes the plurality of specific sections, that is, a specific section 304A, a specific section 304B and a specific section 304C.

Note that the ad hoc network formed by the plurality of vehicles is formed so as to extend over the specific section 304A, the specific section 304B, and the specific section 304C.

As described above, in this embodiment, the area 308 used for determining the change in the traffic signal is set to include the plurality of specific sections, that is, the specific section 304A, the specific section 304B and the specific section 304C. Consequently, information outside the specific section in which the host vehicle is traveling can be used, so that it is possible to improve the accuracy of estimation of the display change cycle of the traffic signal.

It is to be understood that the configurations of the embodiments described above can be appropriately combined to each other within the scope of the invention.

INDUSTRIAL APPLICABILITY

As described above, the traffic information estimation device and the traffic information estimation method according to the present invention are suitable for, for example, application to what supports efficient vehicle operation in accordance with a switching period of a traffic signal display.

REFERENCE SIGNS LIST

100 traffic information estimation device, 101 CPU, 102 memory, 103 timer, 104 external storage device, 105 input device, 106 GPS, 107 display device, 108 beacon receiver, 109 wireless LAN, 201 section identification unit (identification unit), 202 host-vehicle information generation unit (generation unit), 203 other-vehicle information acquisition unit (acquisition unit), 204 information display unit (control unit), 205 vehicle group state determination unit (determination unit), 206 traffic information calculation unit (calculation unit), 207 time management unit (management unit), 208 wireless transmission and reception unit (communication unit), 209 input unit, 301 road, 302 section start point, 303 section end point, 304 specific section, 305 vehicle, 306, 307 and 308 area, 401 distribution data, 402 identifier, 403 position information, 404 time information.

The invention claimed is:

1. A traffic information estimation device mounted on each of vehicles and performing a vehicle-to-vehicle communication between the vehicles on a road on which a traffic signal is installed and forming a network by sharing information via the vehicle-to-vehicle communication, comprising:

an acquirer acquiring a distribution data including position information indicating respective positions of the vehicles and time information indicating time points when the vehicles were present at the respective positions, which are accumulated in each of the vehicles on the road, from one of the vehicles forming the network, and acquiring arrangement information indicating an arrangement of the vehicles in accordance with a time passage on the road on which the traffic signal is installed by using the distribution data;

a determinator determining changes in a density of the vehicles by using the arrangement information; and a calculator calculating a display change cycle indicating a time period of switching of a display of the traffic signal based on a time interval between the changes in the density of the vehicles.

2. The traffic information estimation device according to claim 1, wherein the arrangement information indicates formation of a vehicle group of the vehicles on the road at each of the time points.

3. The traffic information estimation device according to claim 1, wherein the calculator performs determination that the traffic signal is switched to red when the density of vehicles traveling toward the traffic signal changes from sparse to dense or when the density of vehicles traveling away from the traffic signal changes from dense to sparse, and calculates the display change cycle of the traffic signal in accordance with the determination.

4. The traffic information estimation device according to claim 1, wherein the calculator performs determination that the traffic signal is switched to green when the density of vehicles traveling toward the traffic signal changes from dense to sparse or when the density of vehicles traveling away from the traffic signal changes from sparse to dense, and calculates the display change cycle of the traffic signal in accordance with the determination.

5. The traffic information estimation device according to claim 1, wherein the arrangement information acquired by the acquirer indicates an arrangement of vehicles in accordance with a time passage on an opposite lane of the road on which the traffic signal is installed, wherein the determinator determines changes in a density of vehicles on the opposite lane by using the arrangement information, and wherein the calculator calculates the display change cycle of the traffic signal based on a time interval between the changes in the density of vehicles on the opposite lane.

6. The traffic information estimation device according to claim 1, wherein the arrangement information acquired by the acquirer indicates an arrangement of vehicles in accordance with a time passage on a road intersecting the road on which the traffic signal is installed, wherein the determinator determines changes in a density of vehicles on the road intersecting the road on which the traffic signal is installed by using the arrangement information, and wherein the calculator calculates the display change cycle of the traffic signal based on a time interval between the changes in the density of vehicles on the road intersecting the road on which the traffic signal is installed.

7. The traffic information estimation device according to claim 1, further comprising a communicator receiving distribution data including position information indicating positions of the vehicles, and time information indicating time points when the vehicles were present at the positions, wherein the acquirer acquires the arrangement information based on the distribution data received by the communicator.

8. The traffic information estimation device according to claim 7, further comprising a generator generating distribution data including position information indicating a position of a host vehicle, and time information indicating a time point when the host vehicle was present at the position, wherein the communicator transmits the distribution data generated by the generator.

9. A traffic information estimation method performing a vehicle-to-vehicle communication between vehicles via a traffic information estimation device mounted on each of vehicles on a road on which a traffic signal is installed and forming a network by sharing information via the vehicle-to-vehicle communication, the method comprising:

acquiring a distribution data including position information indicating respective positions of the vehicles and time information indicating time points when the vehicles were present at the respective positions, which are accumulated in each of the vehicles on the road, from one of the vehicles forming the network, and acquiring arrangement information indicating an arrangement of the vehicles in accordance with a time passage on the road on which the traffic signal is installed by using the distribution data;

determining changes in density of the vehicles by using the arrangement information; and calculating a display change cycle indicating a time period of switching of a display of the traffic signal based on a time interval between the changes in density of the vehicles.

* * * * *